US011761219B2

(12) United States Patent
Hansort

(10) Patent No.: US 11,761,219 B2
(45) Date of Patent: Sep. 19, 2023

(54) FORM BRACKET FOR CONCRETE PANEL FORM

(71) Applicant: CCS Contractor Equipment & Supply, LLC, Naperville,, IL (US)

(72) Inventor: Marinus Hansort, St. Pete Beach, FL (US)

(73) Assignee: CCS Contractor Equipment & Supply, LLC, Naperville, IL (US)

( * ) Notice: Subject to any disclaimer, the term of this patent is extended or adjusted under 35 U.S.C. 154(b) by 0 days.

(21) Appl. No.: 18/150,878

(22) Filed: Jan. 6, 2023

(65) Prior Publication Data

US 2023/0151622 A1 May 18, 2023

Related U.S. Application Data

(63) Continuation of application No. 17/659,517, filed on Apr. 18, 2022, which is a continuation of application (Continued)

(51) Int. Cl.
*E04G 17/14* (2006.01)
*E01C 19/50* (2006.01)

(Continued)

(52) U.S. Cl.
CPC ..... *E04G 17/14* (2013.01); *E01C 19/502* (2013.01); *E04G 17/02* (2013.01); *E04G 2011/505* (2013.01)

(58) Field of Classification Search
CPC ..... E01C 19/50; E01C 19/502; E01C 19/504; E01C 19/506; E04G 17/06; E04G 17/064;

(Continued)

(56) References Cited

U.S. PATENT DOCUMENTS

D23,610 S * 8/1894 Russell ..... D8/381
844,494 A * 2/1907 Best ..... F22B 37/202 122/510

(Continued)

FOREIGN PATENT DOCUMENTS

CA 2434619 A1 * 1/2004 ..... E04G 13/00
CA 2434619 A1 1/2004

(Continued)

OTHER PUBLICATIONS

Dayton Superior Corporation, Technical Data Sheet—T66 Tilt Bracket, Oct. 23, 2017, Miamisburg, OH.

*Primary Examiner* — Michael Safavi
(74) *Attorney, Agent, or Firm* — Bodman PLC

(57) ABSTRACT

A form bracket for supporting a wall of a concrete panel form at a casting slab includes a first planar member having a lower surface configured to engage a casting slab. A second planar member is coupled with the first planar member. The second planar member has a front surface disposed perpendicular to the lower surface of the first planar member and configured to engage a wall of a concrete panel form. In some implementations, the first and second planar members have different dimensions so as to be capable of being reoriented to accommodate different sized walls. A pair of support members extend between an upper portion of the first planar member and a rear portion of the second planar member. The pair of support members are spaced apart to define a void that is configured to matably receive a second form bracket in a stacked arrangement.

14 Claims, 10 Drawing Sheets

Related U.S. Application Data

No. 16/934,548, filed on Jul. 21, 2020, now Pat. No. 11,359,392.

(60) Provisional application No. 62/882,897, filed on Aug. 5, 2019.

(51) Int. Cl.
*E04G 17/02* (2006.01)
*E04G 11/50* (2006.01)

(58) Field of Classification Search
CPC ..... E04G 17/12; E04G 17/14; E04G 11/365; E04G 2011/505; E04G 17/02; B28B 7/002; B28B 7/0026; B28B 7/0017; B28B 7/0014
USPC .... 249/139; 248/300, 220.1, 250, 235, 48.2; 211/194; 220/236, 505
See application file for complete search history.

(56) References Cited

U.S. PATENT DOCUMENTS 934,414 A * 9/1909 Moran ..... A47B 96/061 248/248
967,419 A * 8/1910 Neidl ..... A47B 96/061 248/248
3,400,847 A * 9/1968 Stute ..... F16B 12/46 217/69
3,493,202 A 2/1970 Jensen
3,606,229 A * 9/1971 Wall ..... A47G 25/08 248/345
3,779,500 A 12/1973 Cox
D251,411 S * 3/1979 Elmore ..... D8/381
4,393,568 A * 7/1983 Navarro ..... E04F 13/00 227/119
D312,962 S * 12/1990 Overton ..... D8/381
5,076,536 A 12/1991 Fitzgerald
5,096,155 A 3/1992 Fitzgerald
5,732,918 A * 3/1998 Steele ..... E04D 13/12 248/237
D400,081 S 10/1998 Ibaragi
5,918,868 A * 7/1999 Bruchman ..... B23B 31/4033 269/238
6,073,405 A * 6/2000 Kasai ..... E04B 1/2403 403/270
6,171,540 B1 * 1/2001 Ibaragi ..... B29C 45/00 248/200
D439,137 S * 3/2001 Ausilio ..... D8/354
6,230,451 B1 * 5/2001 Stoller ..... A63C 19/10 220/9.4
D443,810 S * 6/2001 Ausilio ..... D8/354
6,439,561 B1 * 8/2002 Ausilio ..... B23Q 3/103 269/238
6,536,737 B1 * 3/2003 Davis ..... E04G 13/00 249/210
D621,692 S 8/2010 Clarke
8,225,575 B2 7/2012 Gadd
8,656,655 B2 * 2/2014 Thiessen ..... B65D 90/24 52/169.8
10,251,495 B2 4/2019 Theilen
2002/0062603 A1 * 5/2002 Shaw ..... E04G 13/00 52/125.1
2005/0218277 A1 10/2005 Shaw et al.
2006/0016956 A1 * 1/2006 Bennett ..... E04G 13/00 249/219.1
2007/0215786 A1 9/2007 Nadler
2015/0240516 A1 8/2015 Bertato
2017/0298611 A1 10/2017 Callhan et al.
2018/0112387 A1 4/2018 Bertato
2021/0040754 A1 2/2021 Hansort

FOREIGN PATENT DOCUMENTS

DE 4335388 A1 * 4/1995 ..... E04G 11/365
DE 4335388 A1 4/1995
DE 202012008220 U1 3/2013
DE 202012008220 U1 * 5/2013 ..... E04G 11/365
EP 0093697 A2 * 11/1983 ..... E04G 11/365
EP 0093697 A2 11/1983

* cited by examiner

FORM BRACKET FOR CONCRETE PANEL FORM

CROSS-REFERENCE TO RELATED APPLICATIONS

This application is a continuation application of U.S. non-provisional application Ser. No. 17/659,517, filed Apr. 18, 2022, which claims the benefit and priority of continuation application of U.S. non-provisional application Ser. No. 16/934,548, filed Jul. 21, 2020, now U.S. Pat. No. 11,359,392 which claims benefit and priority under 35 U.S.C. § 119(e) of U.S. provisional application Ser. No. 62/882,897, filed Aug. 5, 2019, the contents of which are hereby incorporated herein by reference in their entireties.

TECHNICAL FIELD

The present disclosure relates to brackets and other devices for supporting concrete forms, and more particularly to brackets for supporting forms that are used to cast concrete slabs and panels, such as a tilt-up and precast panels and the like.

BACKGROUND

Tilt-up or pre-cast concrete panels are typically cast horizontally on a casting bed defined by the upper surface of a pre-existing concrete slab formed on the ground. Once the cast panels have reached sufficient strength, they may be lifted or tilted with a crane and positioned, most often in a vertical orientation, on a prepared foundations. Several tilt-up panels are commonly stood next to each other to form a desired wall of a structure.

SUMMARY

The present disclosure provides a form bracket that may be used to support a boundary wall of a concrete panel form at a casting slab. The supported boundary wall of the concrete panel form may include bulkhead lumber or panels that generally border a perimeter of the concrete panel form in the desired shape of a concrete tilt-up panel that is cast in the form. The form bracket may hold a wall of the concrete panel form in an upright orientation on the casting slab that forms the supportive floor below the concrete panel. The form bracket may include a floor-engaging portion or member and a form-engaging portion or member that are angled relative to each other, such as generally perpendicular relative to each other. Support members or walls may interconnect and support the relative orientation of the floor-engaging member and the form-engaging member, such as to support a lower surface of the floor-engaging member in a generally perpendicular orientation relative to a front surface of the form-engaging member. The form bracket may be formed as a single integral piece, (e.g., an injection molded plastic), such as where the shape of the form bracket may be stackable with other form brackets that have a substantially identical shape. Such optional stackability can provide improved shipping capacity and storage options.

In some implementations, the form bracket may be oriented for multiple uses, such as by reversing the floor-engaging member and the form-engaging member to adapt the form bracket to support form walls with different heights. Further, the floor-engaging member and the form-engaging member may be configured to be attached to the respective casting slab and wall of the concrete panel form with different or multiple forms of attachment, such as to have openings for receiving mechanical fasteners, such as nails or screws, or to have a surface area configured for receiving an adhesive, such as a sprayed adhesive or an adhesive pad. It some implementations, the form brackets can be used multiple times by being cleaned and used again.

According to one aspect of the present disclosure, a form bracket for supporting a wall of a concrete panel form at a casting slab includes a first planar member having a lower surface configured to engage a casting slab. A second planar member is coupled with the first planar member. The second planar member has a front surface disposed perpendicular to the lower surface of the first planar member and configured to engage a wall of a concrete panel form. A pair of support members integrally extend between an upper portion of the first planar member and a rear portion of the second planar member. The pair of support members are spaced apart to define a void that is configured to matably receive a second form bracket with a substantially identical shape to the form bracket in a stacked arrangement.

In some implementations of the form bracket, a front edge of the first planar member is integrally coupled with a lower edge of the second planar member. Also, the length of the first planar member may be is less than a height of the second planar member between the lower edge and an upper edge of the second planar member. As such, upon reorientation of the form bracket, the lower surface of the first planar member may engage the wall of the concrete panel form and the front surface of the second planar member may engage the casting slab.

Optionally, the pair of support members may extend between outer lateral edges of the first and second planar members, where the front and lower surfaces spanning between the pair of support members. In such an arrangement, the void between the pair of support members may open upward from an upper surface of the first planar member and rearward from a rear surface of the second planar member.

In other examples of the form bracket, a slot is defined between inner lateral edges of the first and second planar members, where the pair of support members extend between the inner lateral edges of the first and second planar members. In such an arrangement, an angled brace wall may extend along and interconnects upper edges of the pair of support members, where the void between the pair of support members may open forward from the angled brace wall through the slot.

According to another aspect of the present disclosure, a form bracket for supporting a concrete panel form at a casting slab includes a first member having a first planar surface that is configured to engage a casting slab or a concrete panel form. A second member is coupled with the first member and has a second planar surface that meets the first planar surface at a corner. The second planar surface is configured to engage the other of the casting slab or the concrete panel form. A pair of support members integrally extend between the first member and the second member to support the first planar surface at a fixed angle relative the second planar surface. The first member has a length between the corner and a distal end of the first member that is less than a length of the second member between the corner and a distal end of the second member.

In other implementations of the form bracket, the short planar member may have an outer surface that is configured to engage either the casting slab or the wall of the concrete panel form. Also, the long planar member may have an outer surface that is configured to engage the other one of casting slab or the wall of the concrete panel form. Optionally, the first and second support walls may each be angled outward away from each other as they extend from the first and second lateral edges, such that a second form bracket with a substantially identical shape to the form bracket may stack within the form bracket, such as through an open rear side of its generally triangular prism shape. In further implementations, a mechanical fastener or an adhesive may be used to attach the short planar member or the long planar member to the respective casting slab or wall of the concrete panel form.

The details of one or more implementations of the disclosure are set forth in the accompanying drawings and the description below. Other aspects, advantages, purposes, and features will be apparent upon review of the following specification in conjunction with the drawings.

DETAILED DESCRIPTION

Figure 1:
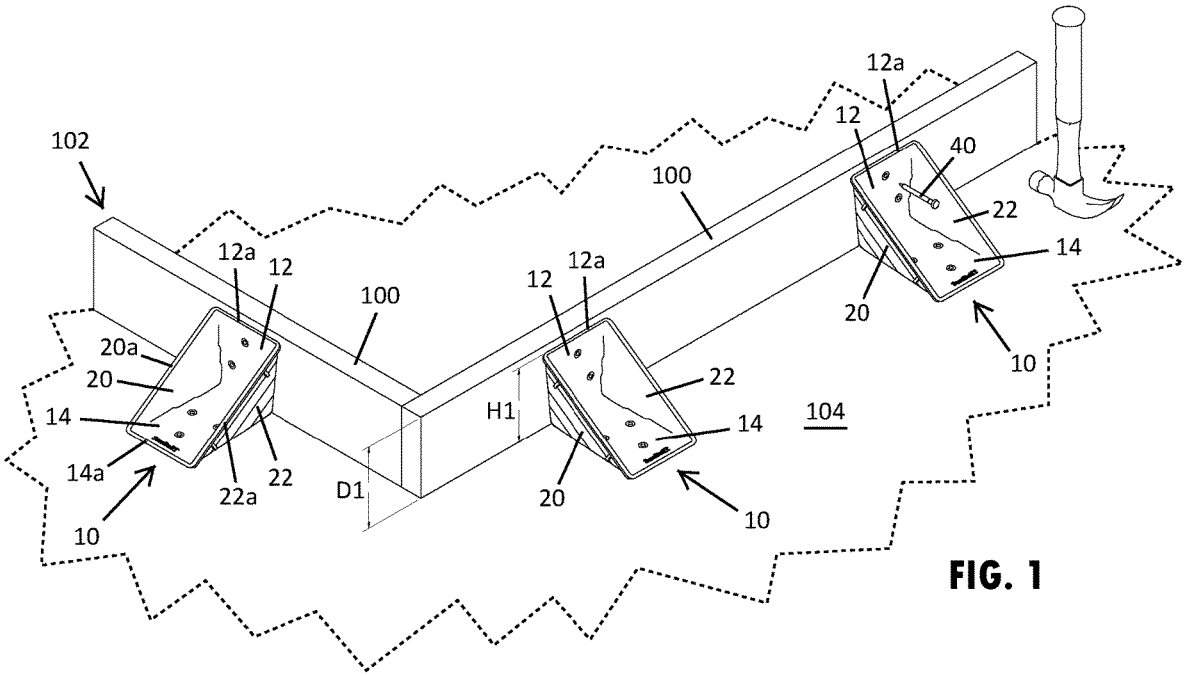
FIG. 1 is an upper perspective view of an exemplary portion of a concrete panel form supported by form brackets at a casting slab.
Figure 2:
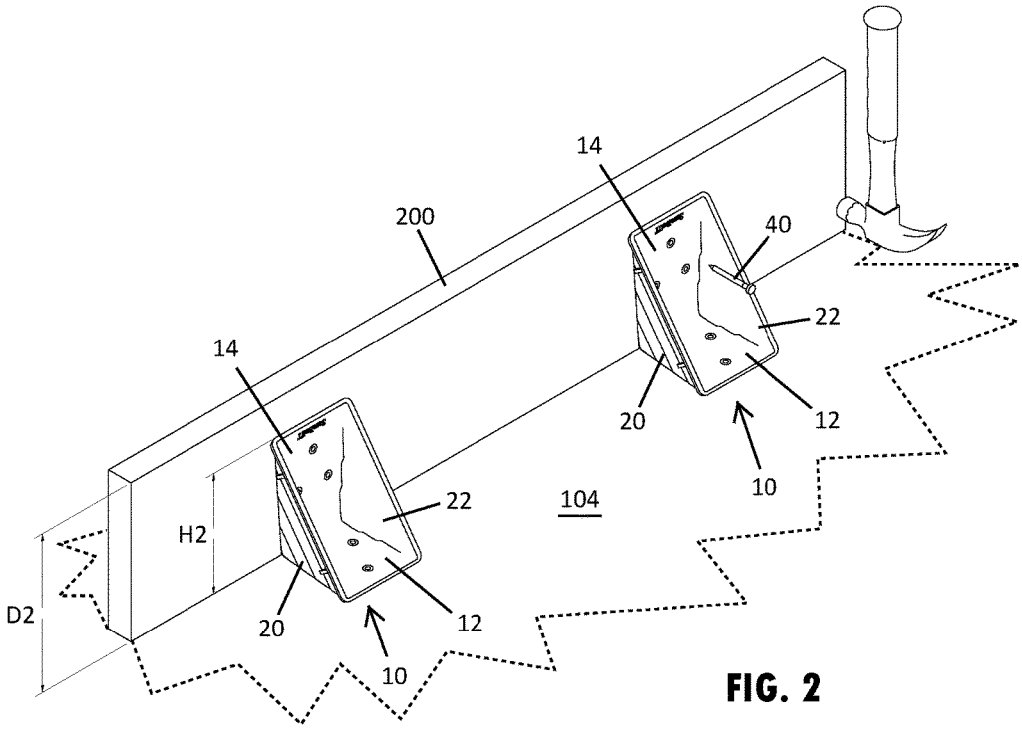
FIG. 2 is an upper perspective view of another exemplary portion of a concrete panel form supported by form brackets at a casting slab.

Referring now to the drawings and the illustrative embodiments depicted therein, a form bracket 10, such as shown in FIGS. 1 and 2, is used to support a wall 100 of a concrete panel form 102 at a casting slab 104. The casting slab 104 is provided to form a base or floor surface of the concrete panel form 102 or casting bed, such that the casting slab 104 may be poured on the ground and cured prior to assembling and arranging the walls 100 of the concrete panel form 102 on the casting slab 104. The upper surface of the casting slab 104 is generally planar and has a surface area that is larger than or otherwise extends beyond the perimeter of the walls 100 of the concrete panel form 102, so that the upper surface of the casting slab 104 outside of the walls 100 may be engaged by the form brackets 10 that are used to the support the walls 100 of the concrete panel form 102. The walls 100 may include bulkhead lumber or panels or the like that generally define a border of the desired shape of a concrete panel that is cast in the form. The walls 100 may be perpendicular relative to each other, such as shown in FIG. 1, to provide a rectangular perimeter shape of the cast concrete panel, which is common for tilt-up concrete panels. However, it is also understood that the walls of the concrete form may be arranged to provide various alternative panel shapes. It is further understood that the wall supported by the form bracket disclosed herein may be a single wall that is supported with one or more form brackets or may be a wall section of a multi-section concrete panel form that is supported by one or more form brackets.

As shown in FIG. 1, the form bracket 10 may hold the wall 100 of the concrete panel form 102 in an upright orientation on the casting slab 104 that forms the floor of the concrete panel form 104, such as shown in a generally perpendicular orientation relative to the upper surface of the casting slab 104. The form bracket 10 may generally include two structurally interfacing members 12, 14, such as a shorter planar member 12 and a longer planar member 14, which are angled relative to each other and are used to interface with and engage the casting slab 104 and the wall 100 of the concrete panel form 102. Accordingly, the interfacing members may be generally referred to as a floor-engaging portion or member and a form-engaging portion or member, depending on the orientation that the form bracket 10 is utilized. As shown in FIG. 1, the form-engaging member 12 has a planar shape and a front surface 16 that is configured to engage the wall 100 of the concrete panel form 102, while the floor-engaging member 14 has a planar shape and a lower surface 18 that is configured to engage the casting slab 104.

In some implementations, the form bracket may be capable of being positioned in multiple orientations to support different sized walls, such as the form bracket 10 that is shown in FIG. 1 being used to support a wall 100 that has shorter height dimension $D_1$, such as 5.5 inches, and shown in FIG. 2 in a different position to support a wall 200 that has a relatively taller height dimension $D_2$, such as 9.25 inches. Accordingly, as shown in FIG. 2, the shorter planar member 12 may be utilized as a floor-engaging portion or member and the longer planar member 14 may be utilized as a form-engaging portion or member. As shown in FIGS. 1 and 2, the shorter planar member 12 has a length (or height $H_1$ in FIG. 1) that is approximately 5 inches and the longer planar member 14 has a length (or height $H_2$ in FIG. 2) that is approximately 7 inches. Thus, the form bracket 10 is capable of being oriented to position its longer dimensioned side (e.g., the longer planar member 14) against a corresponding taller concrete panel form (e.g., wall 200) and to position its shorter dimensioned side (e.g., the shorter planar member 12) against a corresponding shorter concrete panel form (e.g. wall 100). It is understood that other embodiments of the form bracket may have various different dimensions and relative proportions from those illustrated and mentioned above, such as to accommodate taller or shorter concrete panel forms.

Figure 3:
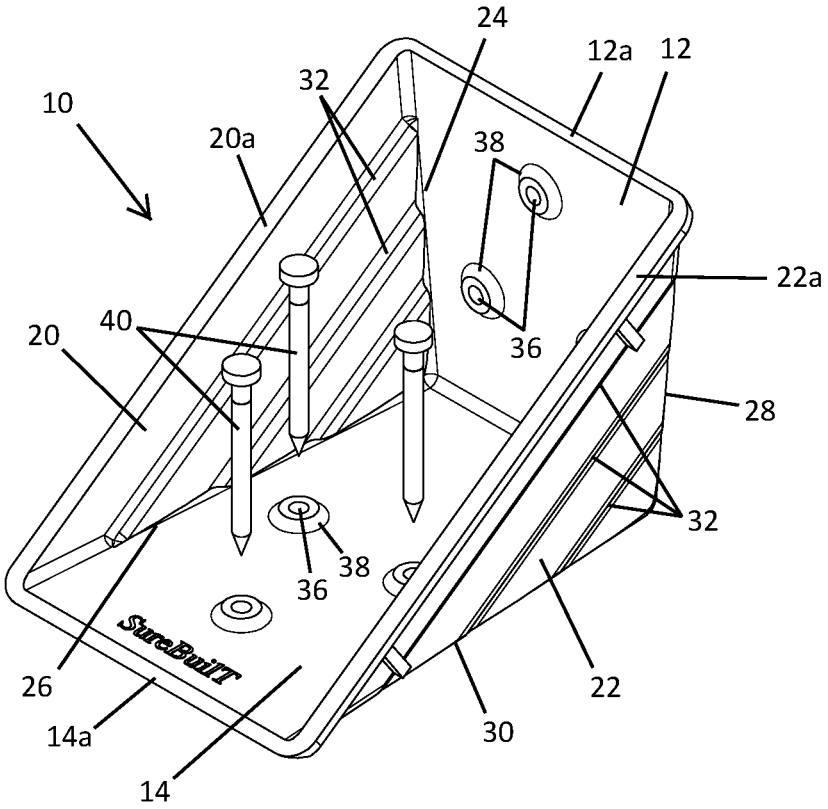
FIG. 3 is an upper perspective view of a form bracket shown in FIGS. 1 and 2, showing nails spaced away from apertures in the form bracket.
Figure 4:
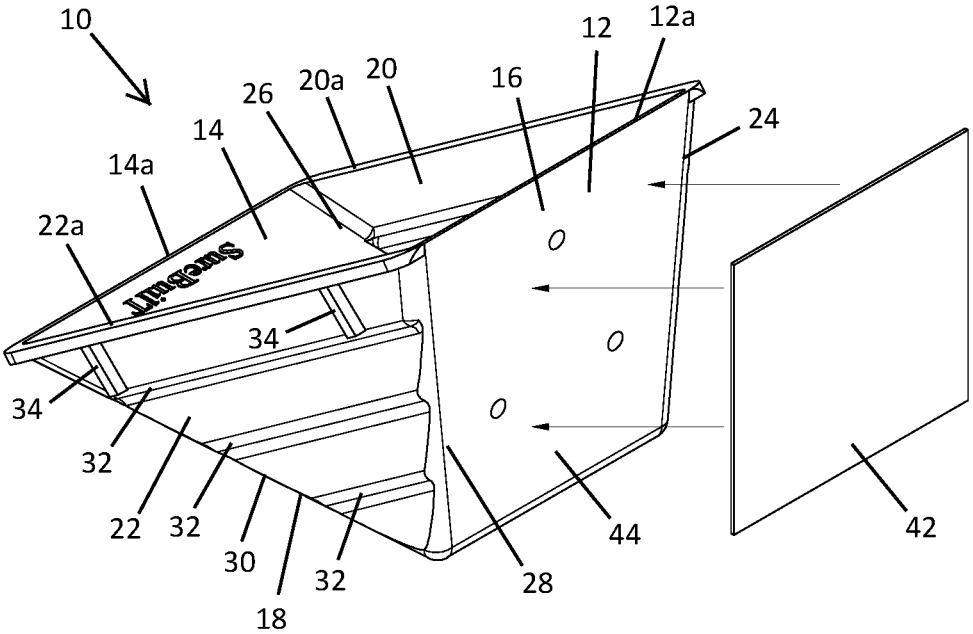
FIG. 4 is an upper perspective view of a form bracket shown in FIGS. 1 and 2, showing an adhesive pad spaced away from an attachment surface of the form bracket.

As shown in FIGS. 3 and 4, the form bracket 10 also includes support members or support walls 20, 22 that extend between the structurally interfacing members 12, 14 to support the structurally interfacing members 12, 14 at a generally fixed angled orientation relative to each other, such as shown with the shorter planar member 12 being generally perpendicular to the longer planar member 14. The support members or walls 20, 22 may interconnect a rear portion of the floor-engaging member and an upper portion of the form-engaging member, so as to be capable of supporting loads there between, such as outwardly directed loads put on the walls 10 by the concrete poured in the concrete panel form. In use, such as shown in FIG. 1, the support walls 20, 22 may support a planar extent of the lower surface of the floor-engaging member 14 in a generally perpendicular orientation relative to a front surface of the form-engaging member 12.

The support walls 20, 22 may be spaced from each other and may connect between the lateral edges of the structural interfacing members 12, 14, such as shown in FIGS. 3 and 4. Specifically, the first support wall 20 extends along the first lateral edge 24 of the short planar member 12 and extends along the first lateral edge 26 of the longer planar member 14. These adjacent lateral edges 24, 26 may thus be interconnected by the first support wall 20. Similarly, the second support wall 22 extends along the second lateral edge 28 of the short planar member 12 and extends along the second lateral edge 30 of the longer planar member 14. These adjacent lateral edges 28, 30 may thus be interconnected by the second support wall 20.

As further shown in FIGS. 3 and 4, the first and second support walls 20, 22 each include a generally planar structure that forms a triangular shape. The upper edges 20*a*, 22*a* of the support walls 20, 22 are generally linear and extend at an angle to smoothly interconnect with the outer edges 12*a*, 14*a* of the structurally interfacing members 12, 14. For instance, as shown in FIG. 1, the upper edge 12*a* of the form engaging member 12 smoothly transitions to the upper edges 20*a*, 22*a* of the support walls 20, 22 that extend downward at an angle to smoothly transition to the rear edge 14*a* of the floor engaging member 14. The generally rectangular shape of the shorter and longer planar members 12, 14, together with the triangular shape of the first and second support walls 20, 22, generally provide a generally triangular prism shape or wedge shape with a hollow or open rear side.

To assist with supporting the angled orientation between the structurally interfacing members 12, 14, the first and second support walls 20, 22 may be structurally reinforced with the inclusion of stiffening features, such as stiffening ridges and/or ribs. As shown in FIGS. 3 and 4, the generally planar structure of the support walls 20, 22 includes stiffening ridges 32 that extend between the shorter and longer planar members 12, 14 in general parallel alignment with the corresponding upper edges 20*a*, 22*a* of the support walls 20, 22. As also shown in FIGS. 3 and 4, the upper portion of the support walls 20, 22 may include reinforcement ribs 34 on the outside surface of the support walls 20, 22 that extend between the upper edge 20*a*, 22*a* and the uppermost stiffening ridge 32. It is contemplated that the support walls in other implementations may have various alternative structural features to provide sufficient tensile loading and support of the engaged walls of concrete panel form.

The form bracket 10, including the structurally interfacing members 12, 14 and the support walls 20, 22, may be formed as a single integral piece, such as via injection molding or stamping or three-dimensional printing or the like. The form bracket 10 shown in FIGS. 1-6 is an injection-molded plastic material, that is capable of providing and reproducing the shape of the form bracket 10, including the stiffening ridges 32 and the reinforcement ribs 34. It is also contemplated that additional implementations of the form bracket may be comprised of metal, fiber reinforced polymers, or other conceivable materials.

The form bracket 10 may engage the respective wall 100 of the concrete panel form 102 and the casting slab 104 to provide a rigid and supportive connection. It is desirable for the connection strength between the form bracket 10 and the wall 100 and ground or casting slab 104 to be sufficient to withstand the forces exerted on the form bracket 10 by the wall 100, such as the outward loads exerted by the concrete poured into the concrete panel form 102. As shown in FIGS. 1-3, the structurally interfacing members 12, 14 each include apertures 36 disposed through one of the floor-engaging member or the form-engaging member, where the apertures 36 are each configured to receive a mechanical fastener that is used to attach the form bracket 10 to the interfacing wall 100 or casting slab 104. The apertures 36 may be arranged over the respective shorter and longer planar members 12, 14 to disperse loads provided by fasteners, such as the three apertures 36 arranged in a triangular shape. The respective shorter and longer planar members 12, 14 may also be reinforced with a collar 38 around each aperture 36, so that the material of the structurally interfacing members 12, 14 can be reduced or optimized in other areas for material mass savings. The mechanical fasteners that engage the apertures 36 may include nails 40, such as shown in FIGS. 1-3, or may additionally or alternatively include screws, nail-screws, or bolts or rebar or the like. More specifically, the nails 40 may be a steel nail or a plastic nail. It is also contemplated that steel screws or plastic screws may utilized. With the use of a plastic nail or a plastic screw, the head or stem of the nail or screw may be cut off when removing concrete cast in the concrete panel form, such that the remaining tip portion of the nail or screw may remain in and cover the hole in cast concrete panel. To further conceal the hole in the concrete formed by the nail or screw, the plastic material of the nail or screw may be substantially the same as the concrete formed in the concrete panel form, so that the remaining tip portion is generally unnoticeable.

Figure 5:
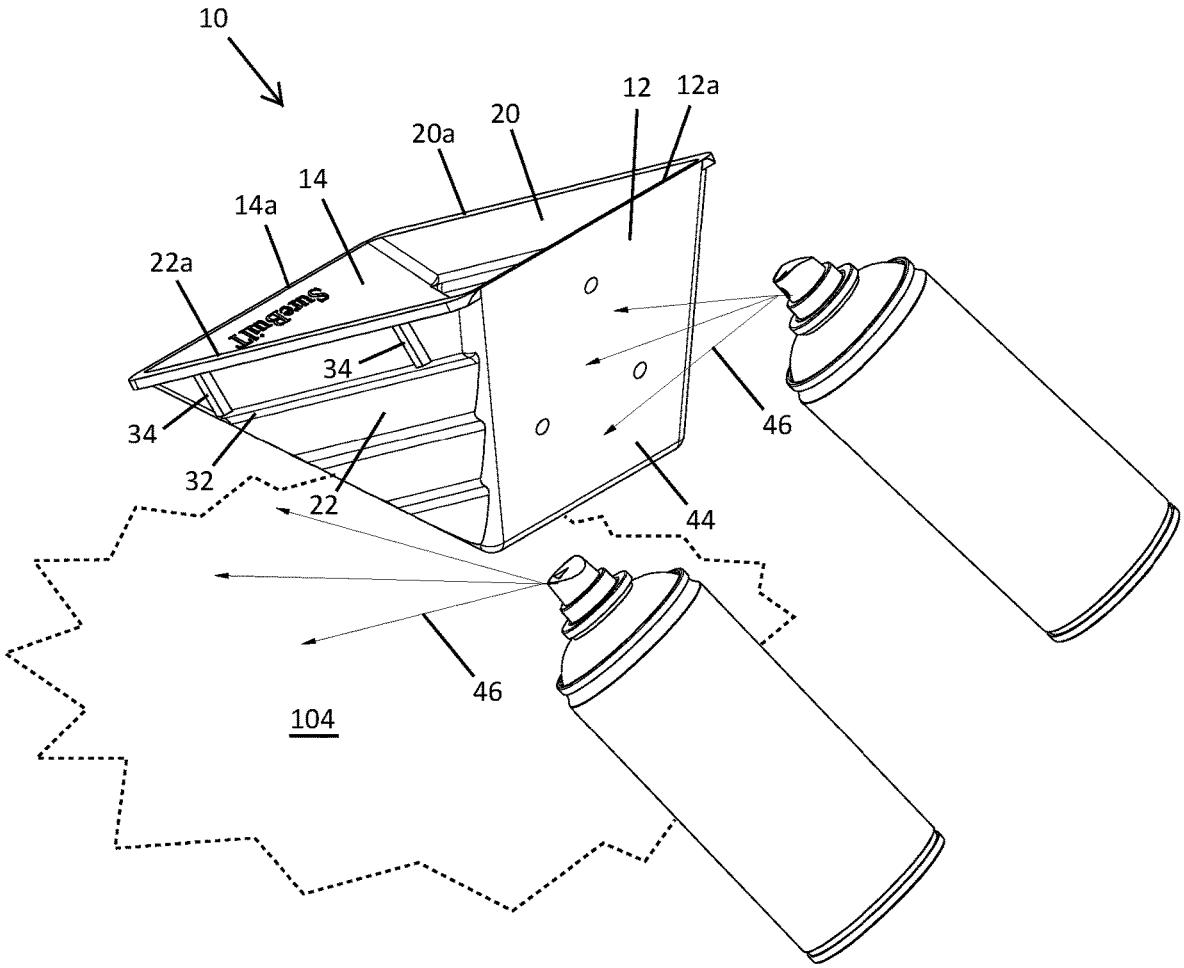
FIG. 5 is an upper perspective view of a form bracket shown in FIGS. 1 and 2, showing adhesive being sprayed on an attachment surface of the form bracket and on a floor surface of the casting slab.

In addition to or in the alternative to the use of mechanical fasteners, an adhesive may be used to attach the form bracket 10 to the interfacing wall 100 or casting slab 104. The surface area of the lower surface of the floor-engaging member and the front surface of the form-engaging member may be sufficiently sized to receive an adhesive that may provide the desired connection strength. As shown in FIG. 4, an adhesive pad 42 may be applied to the attachment surface 44 of the shorter planar member 12. Such an adhesive pad may also be applied to be longer planar member to assist with providing the desired connection strength. Further, as shown in FIG. 5, a liquid adhesive 46 may be sprayed onto the attachment surface 44 of the shorter planar member 12 and/or may be sprayed onto the floor surface of the casting slab 104. Such as spray adhesive may also be applied to be longer planar member or directly the wall to assist with providing the desired connection strength.

Figure 6:
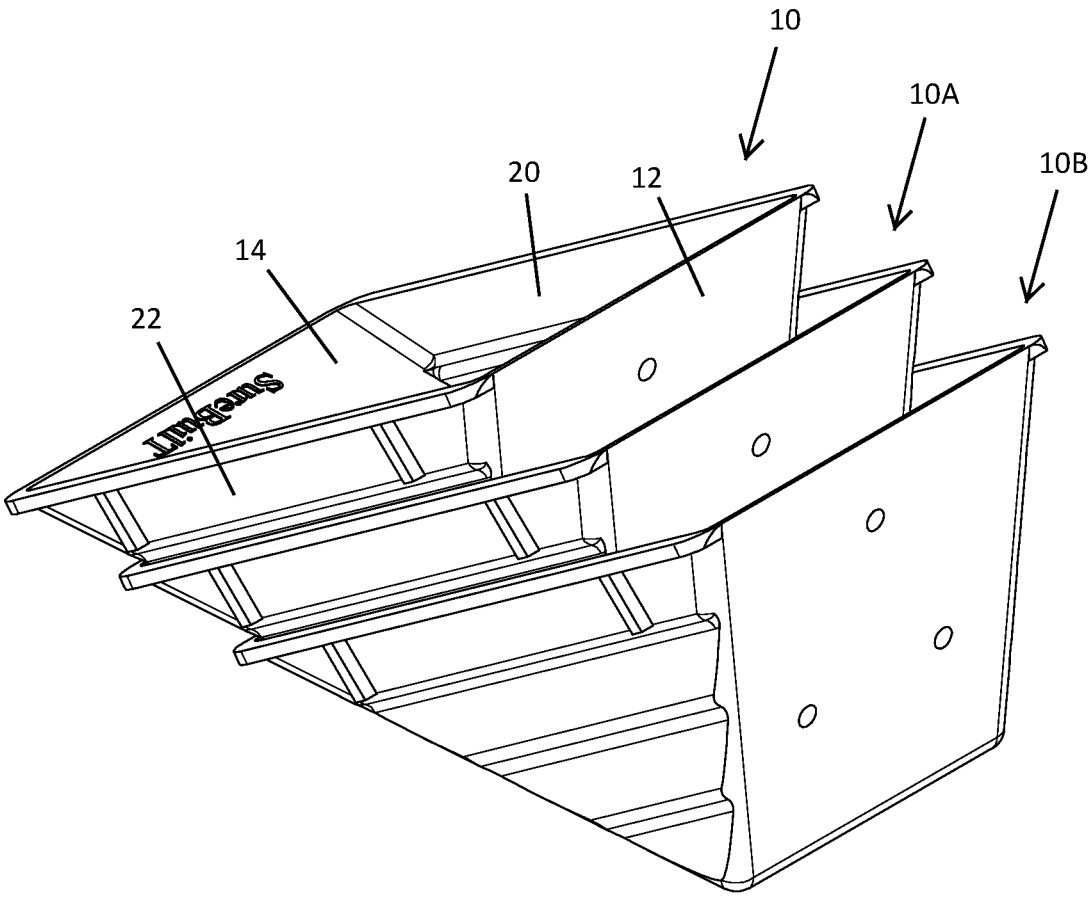
FIG. 6 is an upper perspective view of the three form brackets shown in FIG. 1 matably stacked together.

The support walls 20, 22 are angled outward away from each other as they extend from the first and second lateral edges, such that the support walls 20, 22 are spaced apart to define a void that opens rearward to matably receive another form bracket with a substantially identical shape to the form bracket in a stacked arrangement. As shown in FIG. 6, additional form brackets 10A, 10B with a substantially identical shape to the form bracket 10 are stacked within the form bracket 10 through the open rear side of the generally triangular prism shape. The outward angle may of the support walls 20, 22 may be at least partially provided with the stiffening ridges 32, which may act as steps to progressively position the walls at the outward angle. The stiffening ridges 32 may also assist with the stackability of the form brackets 10 by acting as a stopping structure to provide a consistent insertion distance, thereby preventing over-insertion and frictional sticking of stacked form brackets relative to each other. Thus, the shape of the form bracket 10 may be configured to be stackable with other form brackets that have a substantially identical shape. As shown in FIG. 6, the generally triangular prism shape is configured to matably stack with additional form brackets with a substantially identical shape to the form bracket through the open rear side of the generally triangular prism shape. Such optional stackability can provide improved shipping capacity and storage options.

Also, the form bracket disclosed herein may be adapted for multiple uses, such as by reversing the floor-engaging member and the form-engaging member to adapt the form bracket to support form walls with different heights. Also, the floor-engaging member and the form-engaging member may configured to be attached to the respective casting slab or wall of the concrete panel form with different or multiple forms of attachment, such as to have opening for receiving mechanical fasteners, such as nails or screws, or to have a surface area for receiving an adhesive, such as a sprayed adhesive or an adhesive pad. It some implementations, the form brackets can be engaged in a releasable manner, so as to be capable of being used multiple times.

Referring now FIGS. 7-10A, an additional form bracket 110 is provided that supports a wall of a concrete panel form at a casting slab in the same or similar manner to that shown with the use of form bracket 10 in FIGS. 1 and 2. As such, the form bracket 110 is configured to hold a wall of a concrete panel form in an upright orientation on a casting slab that forms the floor of the concrete panel form. The form bracket 110 also includes two interfacing members 112, 114: a shorter planar member 112 and a longer planar member 114. The interfacing members 112, 114 are angled relative to each other and are used to interface with and engage the casting slab and the wall of the concrete panel form, such that the interfacing members may be generally referred to as a floor-engaging portion or member and a form-engaging portion or member, depending on the orientation that the form bracket 110 is utilized.

Figure 7:
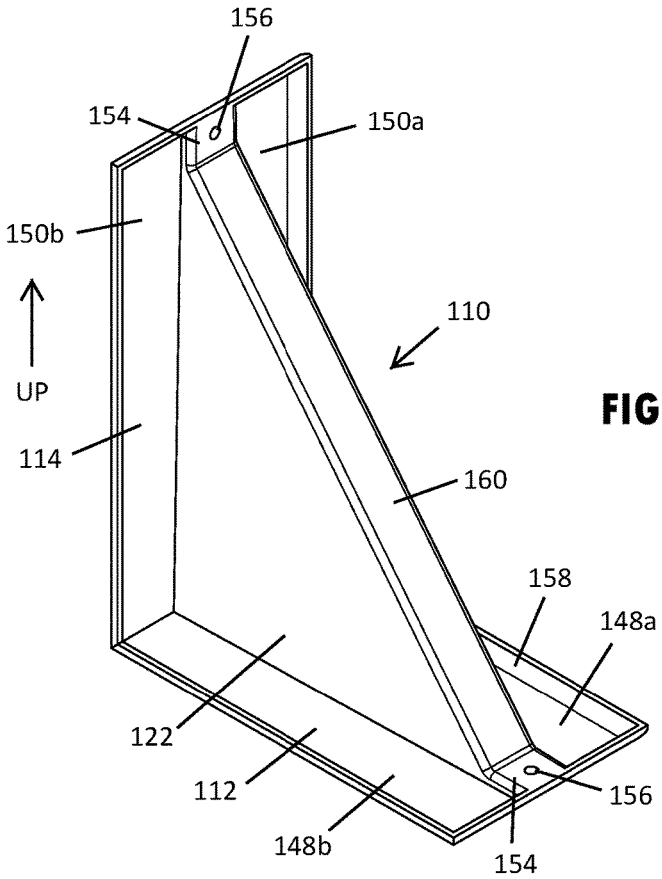
FIG. 7 is an upper perspective view of an additional example of a form bracket.
Figure 8:
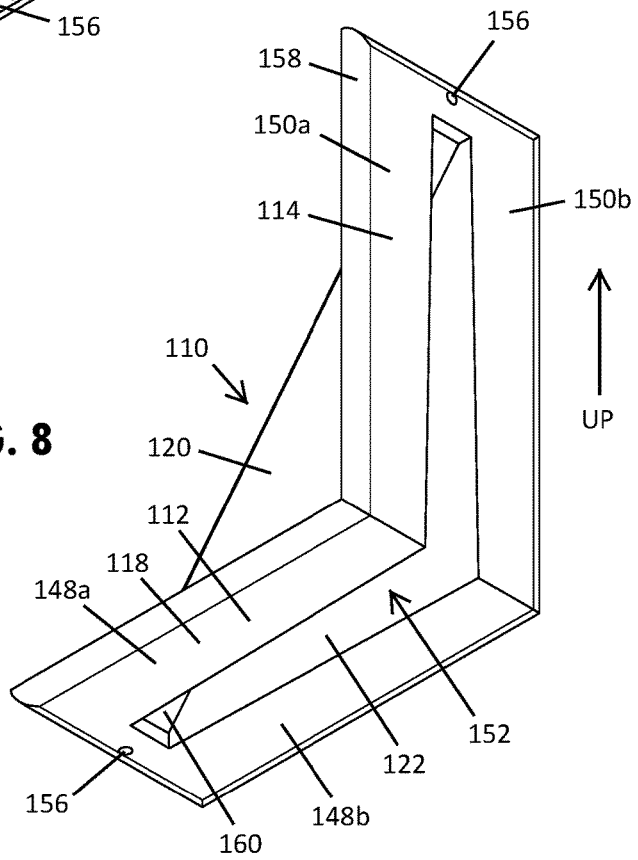
FIG. 8 is a lower perspective view of the form bracket shown in FIG. 7.
Figure 9:
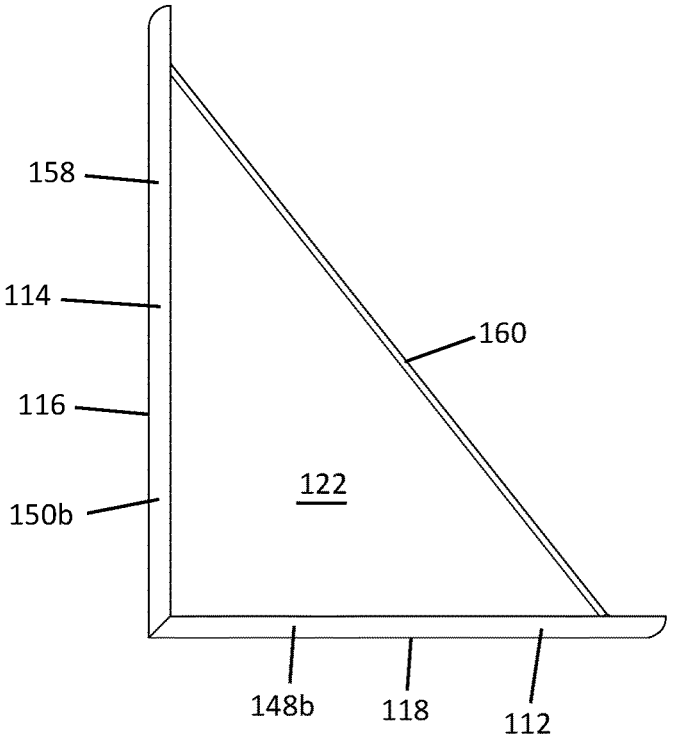
FIG. 9 is a side elevation view of the form bracket shown in FIG. 7.
Figure 9A:
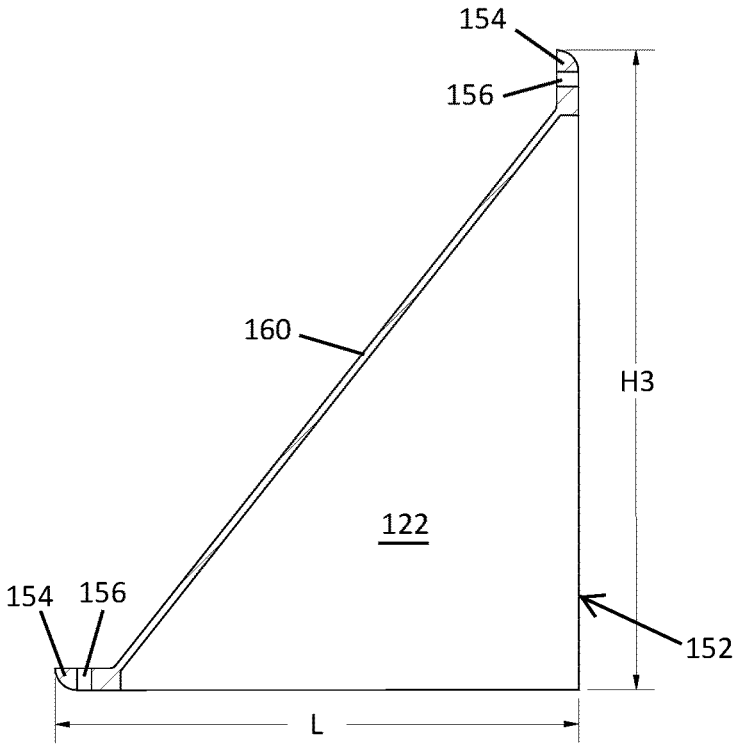
FIG. 9A is a cross-sectional view the form bracket, taken at line A-A in FIG. 10.

As shown in the orientation provided in FIGS. 7-9, the longer planar member 114 is orientated as the form-engaging member of the form bracket 110 to orient the planar, front surface 116 in position to engage the wall of a concrete panel form, while the shorter planar member 112 is oriented as the floor-engaging member of the form bracket 110 to orient the planar, lower surface 118 in position to engage the casting slab. As shown in FIG. 9A, the shorter planar member 112 has a length L (or height if oriented upright) that is approximately 9 inches and the longer planar member 114 has a height $H_3$ that is approximately 11 inches. The form bracket 110 is capable of being re-orientated to vertically position the interfacing member 112 and to horizontally position the interfacing member 114 to support a different sized wall, such as a shorter wall, such as a height greater than 9 inches and less than 11 inches. Thus, the form bracket 110 is capable of being oriented to position its longer dimensioned side (e.g., the longer planar member 114) against a corresponding taller concrete panel form (e.g., a wall taller than 11 inches) and to position its shorter dimensioned side (e.g., the shorter planar member 112) against a relatively shorter concrete panel form.

As shown in FIGS. 7 and 8, the interfacing members 112, 114 each include planar sections 148*a*, 148*b*, 150*a*, 150*b* that are laterally separated from each other by a slot 152. The slot 152 is vertically oriented and is centered between the planar sections 150*a*, 150*b* of the longer planar member 114. Similarly, the slot 152 extends horizontally along the shorter planar member 112 and is centered between the planar sections 148*a*, 148*b* of the shorter planar member 112. The proximal ends of the planar sections 148*a*, 148*b* integrally connect with the corresponding planar sections 150*a*, 150*b* of the other interfacing member at the corner formed between the interfacing members 112, 114. At the opposing distal ends of each of the planar sections 148*a*, 148*b*, 150*a*, 150*b*, a strap section 154 of the respective interfacing member 112, 114 interconnects between the respective planar sections.

As shown in FIGS. 7 and 8, the strap sections 154 have a greater thickness than the planar sections 148*a*, 148*b*, 150*a*, 150*b* of the interfacing members 112, 114 and a fastener opening 156 that is reinforced by the increased material thickness surrounding the opening 156. The fastener openings 156 are each configured to receive a mechanical fastener that is used to attach the form bracket 110 to the interfacing wall or casting slab. For example, the mechanical fasteners may include nails, screws, nail-screws, bolts, or rebar or the like. In addition to or in the alternative to the use of mechanical fasteners, an adhesive may be applied to the lower surface of the floor-engaging member and/or the front surface of the form-engaging member to attach the form bracket 110 to the respective interfacing wall and/or casting slab. The adhesive may be applied in the form of an adhesive pad, a liquid adhesive, an adhesive paste, or a dual-sided tape or the like.

The interfacing members 112, 114 also have a raised border 158 that extends continuously along the outer lateral edges of the planar sections 148*a*, 148*b*, 150*a*, 150*b* and along the distal ends of the interfacing members to interconnect with the strap section 154. As shown in FIG. 7, the raised border 160 extends upward and rearward from the respective planar sections 148*a*, 148*b*, 150*a*, 150*b*, so that upper edge of the raised boarder 160 is generally aligned with the upper surface of the strap section 154, providing a generally consistent lip around the edges of the form bracket 110.

The form bracket 110 also includes support walls 120, 122 that extend between and support the interfacing members 112, 114 at a generally fixed angled orientation relative to each other. As shown in FIGS. 7-9, the shorter planar member 112 is held by the support walls 120, 122 in a generally perpendicular orientation relative to the longer planar member 114. The support walls 120, 122 extend integrally from a rear portion of the form-engaging member 114 and an upper portion of the floor-engaging member 112. As shown in FIG. 8, the support walls 120, 122 extend along the inner edges of the planar sections 148*a*, 148*b*, 150*a*, 150*b* of the interfacing members 112, 114. The support walls 120, 122 are oriented generally perpendicular to the interfacing members 112, 114 to support outwardly directed loads put on the walls of the concrete form that are exerted by the concrete poured in the concrete panel form.

The support walls 120, 122 are spaced from each other and border the slot 152 that separates the planar sections 148*a*, 148*b*, 150*a*, 150*b* of the interfacing planar members 112, 114. The support walls 120, 122 extend from the interfacing planar members 112, 114 and integrally connect with an angled brace wall 160 that is generally perpendicular relative to the support walls 120, 122. The angled brace wall 160 linearly extends along the upper edge of the support walls 120, 122 between the strap sections 154 at the distal ends of the interfacing members 112, 114, such that the angled brace wall 160 is disposed at angle of approximately 50 degrees relative to the shorter planar member 112. As shown in FIGS. 9 and 9A, the support walls 120, 122 each have a triangular shape that is bounded by the angled brace wall 160 and the interfacing members 112, 114. The support walls 120 of the form bracket 110 shown in FIGS. 7-10A are smooth and generally void of stiffening ridges and ribs. However it is contemplated that the support walls in additional implementations may include stiffening features or the like.

Figure 10:
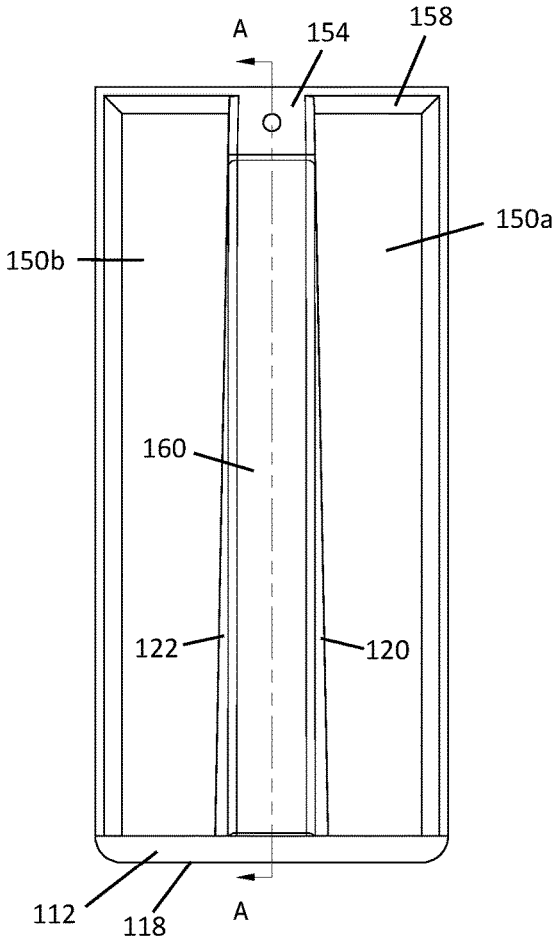
FIG. 10 is a front elevation view of the form bracket shown in FIG. 7.
Figure 11:
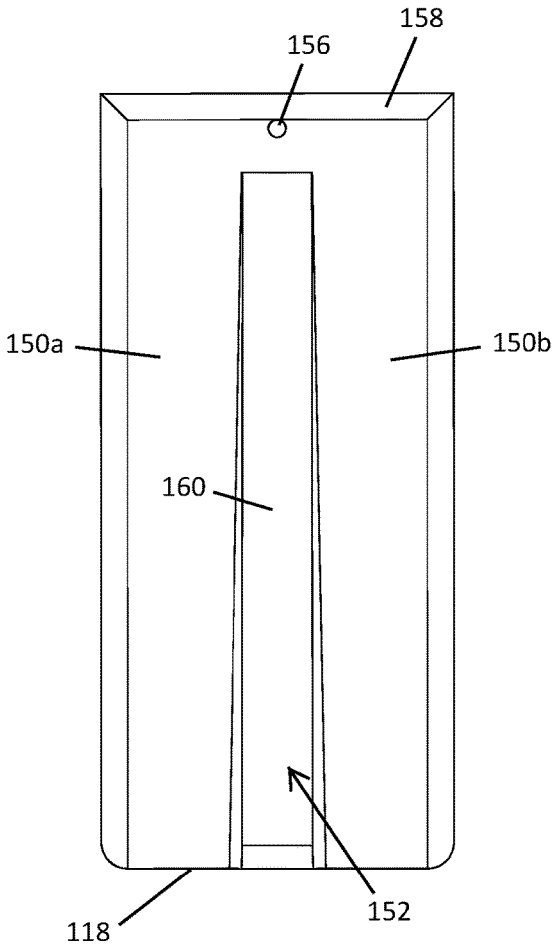
FIG. 11 is a rear elevation view of the form bracket shown in FIG. 7.

As shown in FIGS. 10 and 10A, the support walls 120, 122 are angled slightly toward each other as they extend rearward from the planar members 112, 114 toward the angled brace wall 160. In doing so, the support members 120, 122 are spaced apart to define a void that is forward facing to matably receive a second form bracket with a substantially identical shape to the form bracket in a stacked arrangement. Specifically, the void between the support walls 120, 122 is tapered and capable of receiving the support walls of an identical form bracket 110. Thus, the shape of the form bracket 110 may be configured to be stackable with other form brackets that have a substantially identical shape to improve shipping capacity and storage options.

Furthermore, the form bracket 110 shown in FIGS. 7-10A may be formed as a single integral piece, such as via injection molding or stamping or three-dimensional printing or the like. Also, the form bracket 110 is a plastic material, although the entire bracket or portions thereof may include metal, silicone, rubber, or fiber reinforced polymers.

With reference to FIGS. 12-17, another example of a form bracket 210 is provided that supports a wall of a concrete panel form at a casting slab in the same or similar manner to that shown with the use of form bracket 10 in FIGS. 1 and 2. The form bracket 210 includes a shorter planar member 212 and a longer planar member 214 angled relative to each other to interface with and engage the casting slab and the wall of the concrete panel form, such that the they may be generally referred to as a floor-engaging portion or member and a form-engaging portion or member, depending on the orientation that the form bracket 210 is utilized.

Figure 12:
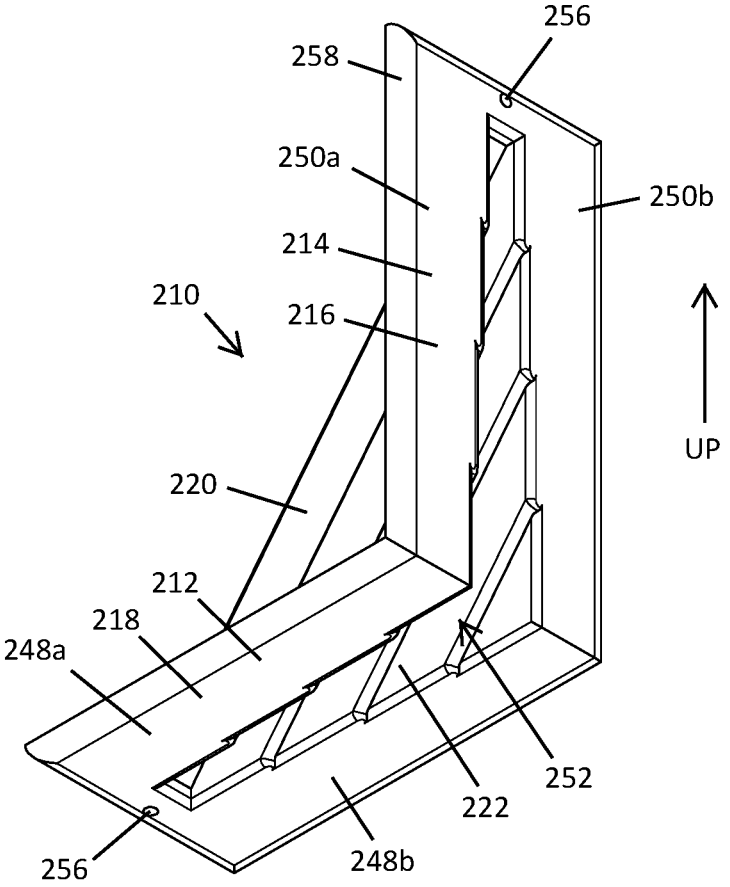
FIG. 12 is a lower perspective view of an additional example of a form bracket.
Figure 12A:
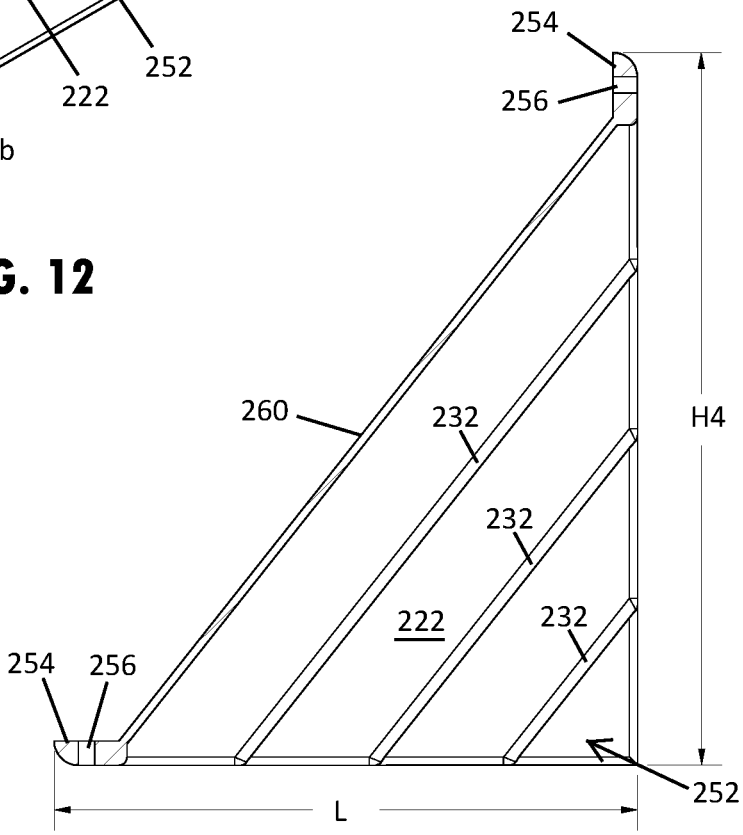
FIG. 12A is a cross-sectional view the form bracket, taken at line A-A in FIG. 13.

As shown in the orientation in FIGS. 12 and 12A, the longer planar member 214 is orientated vertically as the form-engaging member of the form bracket 210 to orient the planar, front surface 216 in position to engage the wall of a concrete panel form, while the shorter planar member 212 is oriented horizontally as the floor-engaging member of the form bracket 210 to orient the planar, lower surface 218 in position to engage the casting slab. As shown in FIG. 12A, the shorter planar member 212 has a length L (or height if oriented upright) that is approximately 9 inches and the longer planar member 214 has a height $H_4$ that is approximately 11 inches. The form bracket 210 is capable of being re-orientated to vertically position the interfacing member 212 and to horizontally position the interfacing member 214 to support a different sized wall, such as a shorter wall, such as a height greater than 9 inches and less than 11 inches. Thus, the form bracket 210 is capable of being oriented to position its longer dimensioned side (e.g., the longer planar member 214) against a corresponding taller concrete panel form (e.g., a wall taller than 11 inches) and to position its shorter dimensioned side (e.g., the shorter planar member 212) against a relatively shorter concrete panel form.

The form bracket 210 includes support walls 220, 222 that extend between and support the interfacing members 212, 214 at a generally fixed angled orientation relative to each other. As shown in FIGS. 12-15, the support walls 220, 222 extend integrally from a rear portion of the form-engaging member 214 and an upper portion of the floor-engaging member 212. As shown in FIG. 8, the support walls 220, 222 extend along the inner edges of the planar sections 248*a*, 248*b*, 250*a*, 250*b* of the interfacing members 212, 214 defined by a slot 252 disposed at a generally centered location between the planar sections 248*a*, 248*b*, 250*a*, 250*b* of the respective shorter and longer planar members 212, 214. The support walls 220, 222 are spaced from each other and border the slot 252 that separates the planar sections 248*a*, 248*b*, 250*a*, 250*b* of the planar members 212, 214. The support walls 220, 222 extend from the interfacing planar members 212, 214 and integrally connect with an angled brace wall 260 that is generally perpendicular relative to the support walls 220, 222.

Figure 13:
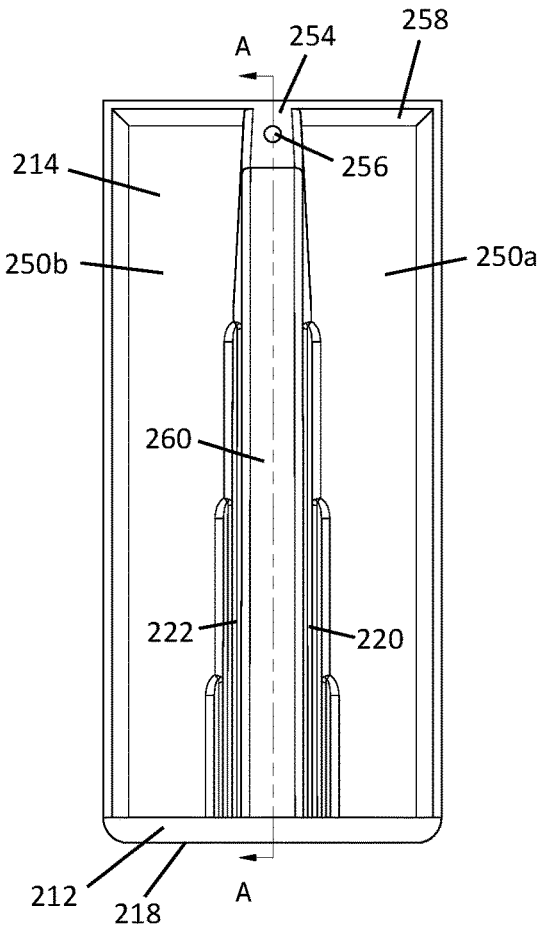
FIG. 13 is a front elevation view of the form bracket shown in FIG. 12.
Figure 14:
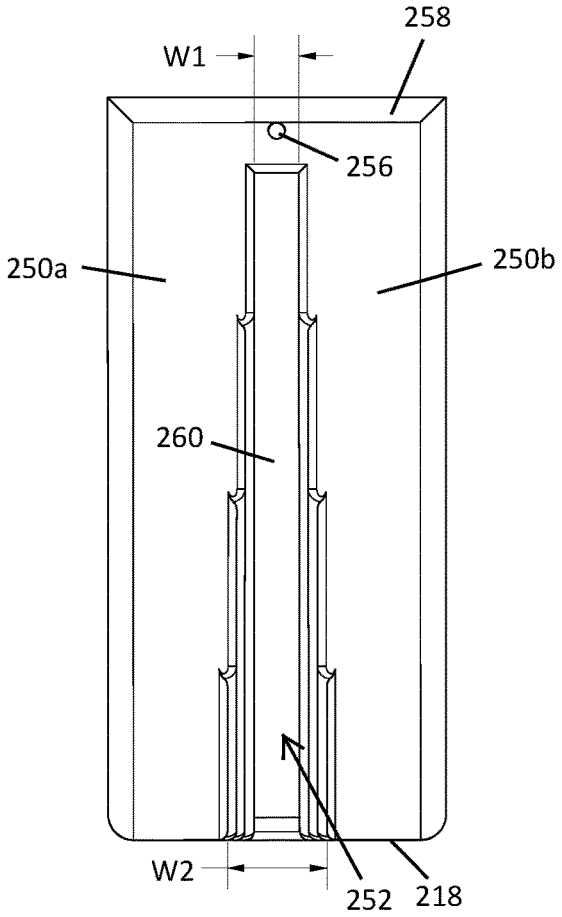
FIG. 14 is a rear elevation view of the form bracket shown in FIG. 12.
Figure 15:
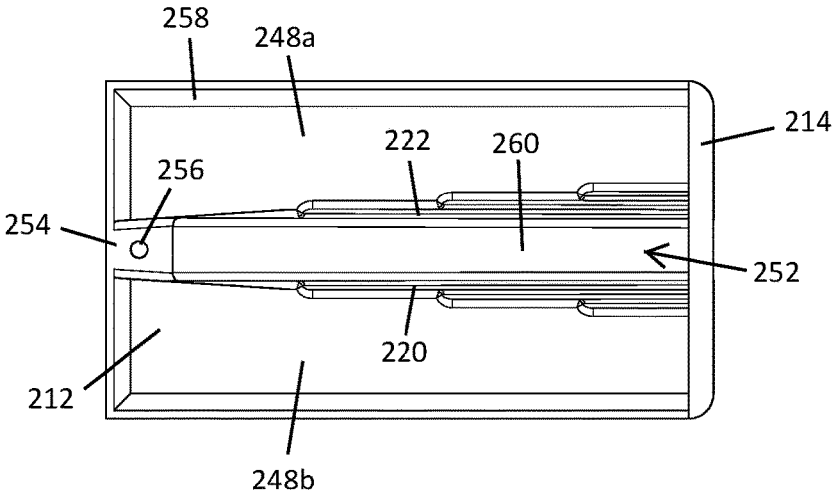
FIG. 15 is a bottom elevation view of the form bracket shown in FIG. 12.

As further shown in FIGS. 12-15, the support walls 220, 222 are structurally reinforced with stiffening ridges 232 that are disposed at the generally planar structure of the support walls 220, 222. The stiffening ridges 232 extend between the shorter and longer planar members 212, 214 at an angle that is in parallel alignment with the angled brace wall 260 that extends along the upper edges of the support walls 220, 222. The support walls 220, 222 are angled inward toward each other as they extend from the corner between the planar members 212, 214 to the angled brace wall 260, whereby the stiffening ridges 232 act as steps between planar sections of the support walls 220, 222 to progressively position the walls closer together. For example, as shown in FIGS. 13-15, the slot 252 near the straps 254 that connect the planar sections 248*a*, 248*b*, 250*a*, 250*b* has a width $W_1$ between the support walls 220, 222 that is less than the width W2 between the support walls 220, 222 near the corner between the planar members 212, 214.

Figure 16:
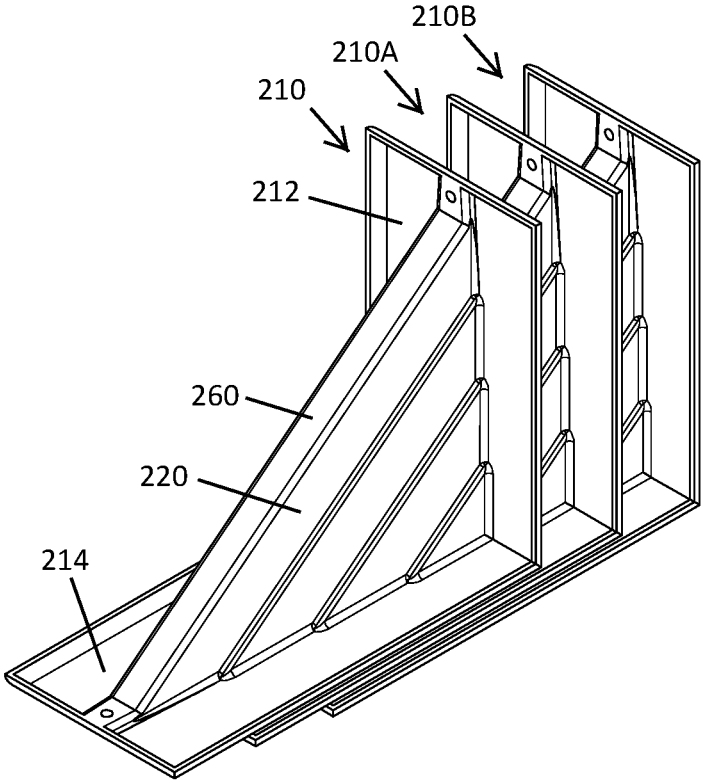
FIG. 16 is an upper perspective view of the three form brackets shown in FIG. 12 matably stacked together.
Figure 17:
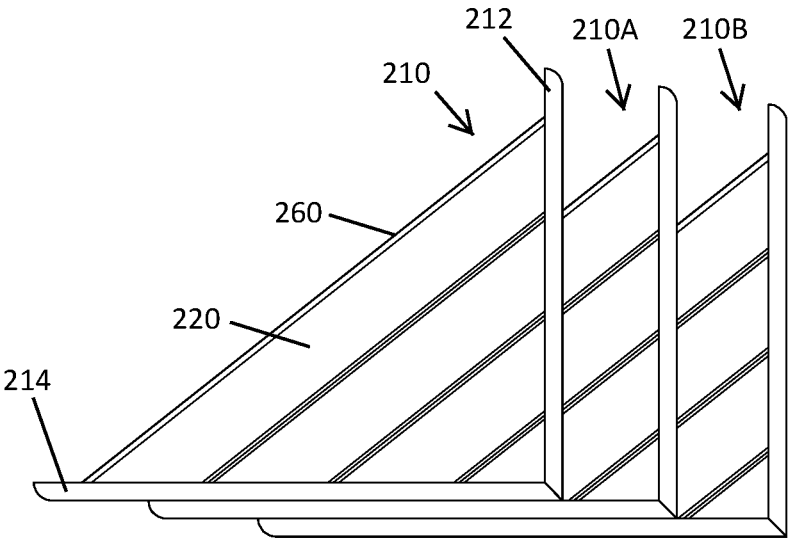
FIG. 17 is a side elevation view of the stacked form brackets shown in FIG. 16.

As shown in FIGS. 16 and 17, additional form brackets 210A, 210B with a substantially identical shape to the form bracket 210 are stacked within the form bracket 210 through the open slot 252 (FIG. 12) at the front side of the form bracket 210. The stiffening ridges 232 assist with the stackability of the form brackets 210, 210A, 210B by acting as a stopping structure to provide a consistent insertion distance, thereby preventing over-insertion and frictional sticking of stacked form brackets relative to each other. Thus, the shape of the form bracket 210 is stackable with other form brackets that have a substantially identical shape. Such optional stackability can provide improved shipping capacity and storage options.

Features of the form bracket 210 that are the same or similar to the form bracket 110 shown in FIGS. 7-11 are not described again in detail but are identified with the same reference numbers, incremented by 100. Also, similar to the form brackets 10 and 110, form bracket 210 is configured to engage a casting slab and wall of a concrete panel from with the use of a mechanical fastener (e.g., through opening 256) and/or adhesive (e.g., applied to the lower surface of the floor-engaging member and/or the front surface of the form-engaging member). For example, the mechanical fasteners may include nails, screws, nail-screws, bolts, or rebar or the like. Also, the adhesive may be applied in the form of an adhesive pad, a liquid adhesive, an adhesive paste, or a dual-sided tape or the like.

For purposes of this disclosure, the term "engage" (in all of its forms, engage, engaging, engaged, etc.) generally means the joining of two components directly or indirectly to one another. Such joining may be stationary in nature or movable in nature; may be achieved with the two components and any additional intermediate members being integrally formed as a single unitary body with one another or with the two components; and may be permanent in nature or may be removable or releasable in nature, unless otherwise stated.

Also for purposes of this disclosure, the terms "upper," "lower," "right," "left," "rear," "front," "vertical," "horizontal," and derivatives thereof shall relate to the orientation shown in FIG. 1. However, it is to be understood that various alternative orientations may be provided, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A form bracket for supporting a concrete panel form at a casting slab, the form bracket comprising:

a first interfacing member comprising a first planar section and a second planar section;

a second interfacing member comprising a third planar section and a fourth planar section, the second interfacing member adjacent the first interfacing member;

an angled brace wall extending planarly and linearly between the first interfacing member and the second interfacing member;

a first support wall extending between the angled brace wall, the first planar section and the third planar section; and a second support wall extending between the angled brace wall, the second planar section and the fourth planar section;

wherein the first planar section is separated from the second planar section by a slot and wherein the third planar section is separated from the fourth planar section by the slot;

wherein a first end of the first planar section extends integrally from a first end of the third planar section and a first end of the second planar section extends integrally from a first end of the fourth planar section;

wherein the brace wall extends adjacent the slot and joins a second end of the first planar section, a second end of the second planar section, a second end of the third planar section, and a second end of the fourth planar section, the second end being respectively opposite the first end; and wherein the first support wall is adjacent the slot on a first side, the second support wall is adjacent the slot on a second side, and the first support wall is not parallel to the second support wall.

2. The form bracket of claim 1, wherein the second interfacing member is perpendicular to the first interfacing member.

3. The form bracket of claim 1, wherein the first interfacing member extends a first length, and the second interfacing member extends a second length, the second length being different than the first length.

4. The form bracket of claim 1, wherein the first planar section and the second planar section are arranged in a first common plane, and wherein the third planar section and the fourth planar section are arranged in a second common plane.

5. The form bracket of claim 1, wherein the first support wall is spaced apart from the second support wall a first separation distance proximate a point where the first interfacing member is adjacent the second interfacing member and a second separation distance proximate the angled brace wall, where the first separation distance is greater than the second separation distance.

6. The form bracket of claim 1 being formed as a single integral piece of inj ection- molded plastic.

7. The form bracket of claim 1, comprising a fastener opening reinforced by increased material thickness surrounding the fastener opening.

8. A form bracket for supporting a concrete panel form at a casting slab, the form bracket comprising:

a first interfacing member comprising a first planar section and a second planar section;

a second interfacing member comprising a third planar section and a fourth planar section, the second interfacing member adjacent the first interfacing member;

a first support wall joining the first planar section and the third planar section, the first support wall having a first triangular shape, the first triangular shape having a first edge extending along the first planar section and a second edge extending along the third planar section; and a second support wall joining the second planar section and the fourth planar section, the second support wall having a second triangular shape having a first edge extending along the second planar section and a second edge extending along the fourth planar section;

wherein the first planar section is separated from the second planar section by a slot and wherein the third planar section is separated from the fourth planar section by the slot;

wherein a first end of the first planar section extends integrally from a first end of the third planar section and a first end of the second planar section extends integrally from a first end of the fourth planar section; and wherein the first support wall defines a first border of the slot and wherein the second support wall defines a second border of the slot, the slot being an open void between the first support wall and second support wall and bounded by the first interfacing member and second interfacing member; and wherein the first support wall is not parallel to the second support wall.

9. The form bracket of claim 8, wherein the second interfacing member is perpendicular to the first interfacing member.

10. The form bracket of claim 8, wherein the first interfacing member extends a first length, and the second interfacing member extends a second length, the second length being different than the first length.

11. The form bracket of claim 8, wherein the first planar section and the second planar section are in a first common plane, and wherein the third planar section and the fourth planar section are in a second common plane, the second common plane perpendicular to the first common plane.

12. The form bracket of claim 8, wherein the first support wall is spaced apart from the second support wall a first separation distance proximate a first point where the first interfacing member is adjacent the second interfacing member and a second separation distance at a second point spaced apart from the first point along the first interfacing member, where the first separation distance is greater than the second separation distance.

13. The form bracket of claim 8, further comprising a brace wall extending between the first support wall and the second support wall.

14. The form bracket of claim 13, wherein the brace wall extends linearly and planarly, and the form bracket is formed as a single integral piece of injection-molded plastic.

* * * * *